US006180545B1

(12) United States Patent
Okeya et al.

(10) Patent No.: US 6,180,545 B1
(45) Date of Patent: Jan. 30, 2001

(54) REFLECTING WARP-KNIT TAPE FOR SLIDE FASTENER

(75) Inventors: Sadaji Okeya; Hideyuki Matsushima; Yoshio Matsuda, all of Toyama (JP)

(73) Assignee: YKK Corporation, Tokyo (JP)

( * ) Notice: Under 35 U.S.C. 154(b), the term of this patent shall be extended for 0 days.

(21) Appl. No.: 09/071,742

(22) Filed: May 1, 1998

(30) Foreign Application Priority Data

May 2, 1997 (JP) ..... 9-114853
May 2, 1997 (JP) ..... 9-114854

(51) Int. Cl.[7] ..... D04B 21/14

(52) U.S. Cl. ..... 442/308; 442/316; 442/317; 442/232; 66/192; 66/193

(58) Field of Search ..... 442/307, 316, 442/317, 232; 139/420 R; 66/202, 193, 192

(56) References Cited

U.S. PATENT DOCUMENTS

| | | | | |
|---|---|---|---|---|
| 3,864,946 | | 2/1975 | Matsuda . | |
| 4,444,026 | | 4/1984 | Matsuda . | |
| 4,632,863 | | 12/1986 | Henningsson . | |
| 4,871,597 | * | 10/1989 | Hobson | 428/36.1 |
| 5,728,448 | * | 3/1998 | Okeya et al. | 428/193 |

FOREIGN PATENT DOCUMENTS

| | | |
|---|---|---|
| 0 791 306 A1 | 8/1997 | (EP) . |
| 2 335 124 | 7/1977 | (FR) . |
| 2 625 017 | 6/1989 | (FR) . |

OTHER PUBLICATIONS (1) An English abstract for French patent 2 335 124.
(1) An English abstract for French patent 2 625 017.

* cited by examiner

*Primary Examiner*—Newton Edwards
*Assistant Examiner*—Chris Cronin
(74) *Attorney, Agent, or Firm*—Finnegan, Henderson, Farabow, Garrett & Dunner, L.L.P.

(57) ABSTRACT

A reflecting warp-knit slide fastener tape is knitted with several kinds of knitting patterns. A marginal portion onto which fastener elements are attached extends along one longitudinal edge of the tape. The marginal portion is formed by tricot-stitch yarns, weft-inlaid yarns, and chain-stitch yarns which prevent the marginal portion from stretching. In the web portion, in addition to the tricot-stitch yarns and the weft-inlaid yarns one or more reflective members, which is in the form of a strip of retroreflective or light-reserve reflective film, are knitted in between wales contiguous to the marginal portion. The reflective members are sandwiched between the weft-inlaid and tricot-stitch yarns. The tricot-stitch yarns are transparent synthetic fiber yarns in order not to obstruct the reflecting feature of the reflective members. The resulting reflecting portion is exposed to the front surface of the tape continuously along its entire length, giving a neat appearance particularly suitable for the dress and the traffic-safety clothing as well.

20 Claims, 15 Drawing Sheets

REFLECTING WARP-KNIT TAPE FOR SLIDE FASTENER

BACKGROUND OF THE INVENTION

1. Field of the Invention

The present invention relates to a tape for a slide fastener, and more particularly to a reflecting warp-knit slide fastener tape whose element-attaching marginal portion is restricted in warpwise stretchability by specifying the substances and individual warp-knitting patterns of knitting yarns and in which one or more reflective cords as of a light-reflective material are knitted in a portion contiguously inside of and along the element-attaching marginal portion. The presence of this resulting reflecting portion can be seen even from a distant place as It reflects light illuminated especially at night.

2. Description of the Related Art

Japanese Utility Model Laid-Open Publication No. Sho 63-135390 discloses a slide fastener tape in which a retroreflecting sheet is attached to a local portion of the tape surface. Republic of China Patent No. 284984 discloses a retroreflecting slide fastener tape in which a retroreflective strip is knitted contiguously to and along an element-attaching marginal portion by every several weft yarns so as to extend warpwise in a meandering pattern such as to be exposed alternately to front and rear surfaces of the tape.

In the retroreflecting slide fastener tape of the first-named publication, since the retroreflective sheet is attached to the front surface of the tape using an adhesive means, there is a fear that such retroreflective sheet might be peeled off the tape while the slide fastener is in use, so that an effective and reliable reflective feature cannot be retained for a long term, thus resulting in only an inadequate durability.

In the retroreflecting slide fastener tape of the second-named publication, although the retroreflective strip would not be peeled off the tape, the same retroreflective strip would tend to suffer possible damages, if exposed to the front tape surface to an elongated extent, as the retroreflective strip is merely woven at regular distances by weft yarns. And if the retroreflective strip is exposed to the front tape surface to only a limited extent, it would be impossible to expect a continuous high-definition reflecting feature. Further, due to its relatively complex woven structure, the tape portion in which the retroreflective strip is woven would be thick and rigid.

SUMMARY OF THE INVENTION

With the foregoing problems in view, it is an object of the present invention to provide a reflecting warp-knit tape, for a slide fastener, which is thin and adequately flexible and in which various kinds of one or more reflective cords are sandwiched from their front and rear sides by knitting yarns without being peeled or removed off the tape after long-term use, giving a refined eye-catching design feature which is particularly suitable for an ornament of the dress and the traffic-safety clothing. Especially the tape of this invention has a feature that the reflecting portion are exposed to the front surface of the tape continuously along its entire length without being obstructed by the knitting yarns.

According to a first aspect of the invention, the above object is accomplished by a reflecting warp-knit tape for a slide fastener having a plurality kinds of warp-knit structures, comprising: a longitudinal web portion; and an element-attaching marginal portion extending contiguous to and along a longitudinal edge of the web portion. The element-attaching marginal portion has a knit structure which is longitudinally non-stretchable. The web portion has a reflecting portion composed of at least a reflective member made of reflective material.

In the present invention, "knitting of the reflecting member" inclusively means "forming a wale directly by the reflecting member itself which serves as a knitting yarn while forming a succession of stitches of the reflecting member" and "merely laying the reflecting member between adjacent wales so as to hold the reflecting member at its front and rear sides by other knitting yarns".

With this arrangement, since the reflective members are knitted in the web portion simultaneously with the knitting of the warp-knit tape, it is possible to secure adequate flexibility of the warp-knit tape and also to attach the reflective members to the tape in a stabilized posture without being peeled or removed off the tape, comparing to the case where the reflective members are adhered or sewn onto the web portion.

According to a second aspect of the invention, the reflecting portion is formed by knitting the reflective member adjacent to an inner side of the longitudinal edge of the marginal portion of the web portion to extend substantially parallel to the element-attaching marginal portion. With this arrangement, the reflective member is knitted in contiguous to and along the marginal portion of the fastener element row that is the least stretchable and the most eye-catchable position. It is therefore possible to maintain the reflective members in their knit structure as any unnecessary stress would not be exerted on the reflective members knitted in the warp-knit tape and to surely appeal the existence of the reflective members.

According to a third aspect of the invention, the reflecting portion is formed by knitting the reflective member weftwise centrally in the web portion and extends longitudinally thereof, so that the position of the reflective members with respect to the fastener elements would not be different even if the fastener elements are mounted on either one of opposite marginal portions of the warp-knit tape, thus facilitating attaching the fastener elements, managing production of warp-knit tapes and maintenance as well.

According to a fourth aspect of the invention, wales of the web portion located at opposite sides of the reflecting portion are bulkier than the remaining wales, so that the reflective members are protected by their adjacent bulky wales from being touched by other things.

According to a fifth aspect of the invention, the reflective member formed of a strip of reflective film is knitted in to be located between adjacent wales and to be held by and sandwiched between other knitting yarns. With this arrangement, even though each reflective member is thin and narrow, since there disposed several reflective members together, the reflective members can be easily observed by naked eyes even from a distant place. And also, the reflective members fitted in the interwale spaces would hardly be displaced sideways as they restricts each other's movement.

According to a sixth aspect of the invention, the reflective member formed of a strip of reflective film is knitted in to be located between adjacent wales and to be held by and sandwiched between other knitting yarns, and the knitting yarns have different knitting patterns, so that a front surface of the reflective member can be sandwiched from its front and rear sides by the plurality of knitting yarns. Therefore, the reflective member are held firmly from the front and rear sides by the knitting yarns and are free from becoming wavy or puckered toward the front and/or rear sides.

According to a seventh aspect of the invention, the reflective member is knitted in to be located between adjacent wales and to be held by and sandwiched between other knitting yarns, and those of the knitting yarns exposed over a front surface of the reflective member are transparent thermoplastic synthetic fiber yarns. Since a transparent material is used for the knitting yarn to hold the reflective members, it is possible to secure the reflection performance of the reflecting members so that no influence on the eye-catching feature would occur even in the case that the front surfaces of the reflective members are sandwiched by the plurality of knitting yarns. Further, since the transparent knitting yarns may be located only in the interwale space, in which the reflective member is placed, rather than the entire tape width, it is possible that its flexibility would not be lost, unlike the woven tape.

According to an eighth aspect of the invention, the reflective member formed of a strip of reflective film is knitted in to be located between adjacent wales and to be held by and sandwiched between other knitting yarns, and the knitting yarns have a knitting pattern to extend parallel to courses of the web portion so that the front surface of the reflective member is held by the knitting yarns extending parallel to the courses. Such arrangement of the knitting yarns enables the reflecting surface of the reflective member to expose effectively.

According to a ninth aspect of the invention, each of the reflective members is formed of a narrow strip of retroreflective or light-reserve reflective film knitted in to be located between adjacent wales and to be held by and sandwiched between other knitting yarns. It is therefore possible to simply knit the reflecting portion by using the strip of retroreflective or light-reserve reflective film and to expose the reflecting portion continuously with ease, thus improving an ornamental feature and giving an excellent reflection feature.

According to a tenth aspect of the invention, the reflective member is in the form of a narrow strip of foil or a yarn, of silver or gold, or is composed of a core cord of a thermoplastic synthetic fiber yarn and a narrow strip of retroreflective film wound around the core cord, and each reflective member is knitted in to be located between adjacent wales and to be held by and sandwiched between other knitting yarns. With this arrangement, it is possible to easily manufacture the knitting yarn on which the retroreflective film is wound as the reflective member and a high-definition reflecting portion can be formed, thus realizing an excellent reflection feature of the warp-knit tape.

An eleventh aspect of the invention, a plurality kinds of the reflective members are each knitted in to be located between adjacent wales and to be held by and sandwiched between other knitting yarns, and the other knitting yarns are two or more knitting yarns of different kinds. In this arrangement, different kinds of materials and structures are used for the reflective member and the holding knitting yarns, thus respective characteristics show in synergy and complement one another, and improved eye-catchability and durability as a whole can be guaranteed.

According to a twelfth aspect of the invention, the reflective member is a knitting yarn composed of a core cord of a thermoplastic synthetic fiber yarn and a narrow strip of retroreflective film wound around the core cord, and each knitting yarn forms a wale.

According to a thirteenth aspect of the invention, the reflective member which is in the form of a yarn or thread is used as a yarn constituting the web portion, and the reflective member is knitted directly as the knitting yarn so as to form a wale. In this structure, the individual reflective member is attached to the web portion integrally and tightly without a sense of incompatibility with the other knitting yarns, thus stabilizing the posture of the reflective member and increasing the durability to a remarkable extent. Further, since the reflective members are used as the knitting yarns forming the wales, it is possible to expose the individual reflective member continuously with no interruption warpwise along its entire length, thus improving the eye-catchability as compared to the foregoing fifth to eleventh aspects of the invention.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The principle of the present invention is particularly useful when applied to a reflecting warp-knit tape for a slide fastener, various preferred embodiments of which will now be described with reference to the accompanying drawings.

Figure 1:
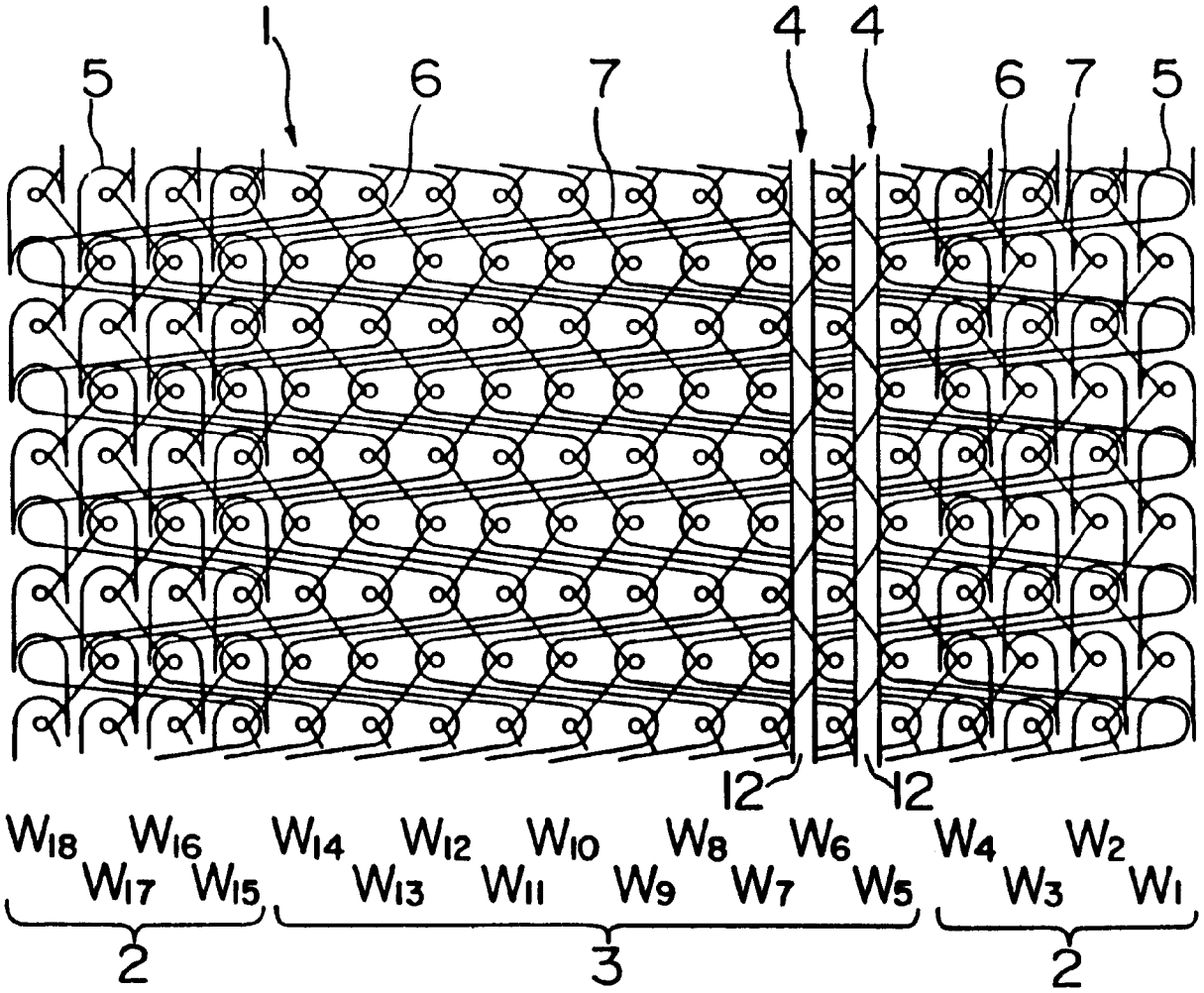
FIG. 1 is a fragmentary diagram of a reflecting warp-knit tape, for a slide fastener, according to a first embodiment of the present invention, showing a detailed warp-knit structure of the tape.
Figure 2:
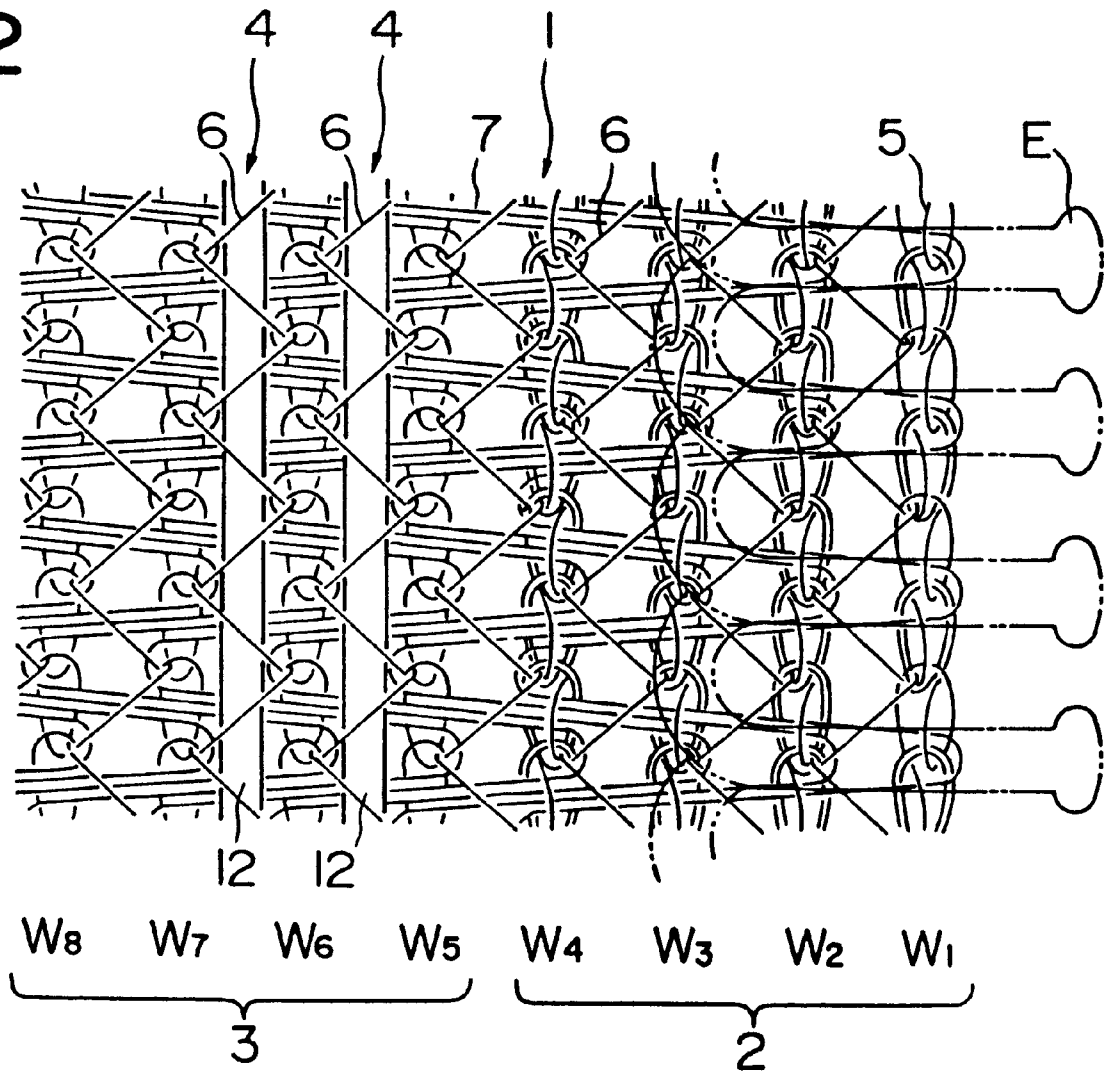
FIG. 2 is an enlarged, fragmentary diagram of the warp-knit tape of FIG. 1.

FIGS. 1 and 2 show a reflecting warp-knit tape 1, for a slide fastener, which has a plurality of kinds of knit structure according to a first embodiment of the invention. The warp knit tape 1 comprises a continuous length of adequately flexible central web portion 3 and a pair of marginal portions 2 disposed contiguous to and extending one along each of opposite longitudinal edges of the central web portion 3. In a subsequent step of the manufacture of slide fasteners, a row of fastener elements are attached to a selected one of the two marginal portions 2 such as by sewing; accordingly, either marginal portion may serve to support the fastener element row E and is hence hereinafter called the element-attaching marginal portion. As a pivot characteristic feature of the present invention, the web portion 3 includes a reflecting portion 4 provided by knitting at several wales inwardly of one of the element-attaching marginal portions 2.

The warp-knit tape 1 of this embodiment is a simple tape entity devoid of a fastener element row to be mounted on it by knitting. The first to eighth wales $W_1$–$W_8$ of the warp-knit tape 1 has a warp-knit structure shown in FIG. 2. The warp-knit tape 1 is composed of thermoplastic synthetic fiber yarns in the form of monofilaments or multifilaments, as of polyamide, polyester, etc., as knitting yarns. With each of all wales $W_1$–$W_{18}$ of the warp-knit tape 1, a plurality of tricot-stitch yarns 6 having a knitting pattern of 1-2/1-0 and a plurality of weft-inlaid yarns 7 having a knitting pattern of 0-0/4-4 are interlooped or interlaced, and further in each of wales $W_1$–$W_4$, $W_{15}$–$W_{18}$, a chain-stitch yarn 5 is knitted in a pattern of 1-0/0-1 which fairly restricts longitudinal stretchability of the knitted foundation. The fastener elements E are sewn onto the knitted foundation with a sewing thread or the like. In this embodiment, narrow strips of retroreflective films 13 are used as reflective members 12.

A pair of reflecting members 12, each in the form of a narrow strip of retroreflective film 13, are located adjacent to each other and between the fifth and sixth adjacent wales $W_5$–$W_6$ and the sixth and seventh adjacent $W_6$–$W_7$, respectively. The weft-inlaid yarns 7 are arranged on the rear side of the web portion 3 and the tricot-stitch yarns 6 are arranged on the front side of the web portion 3, thus sandwiching the retroreflective films 13. Further, the tricot-stitch yarns 6, which are exposed over the front surfaces of the retroreflective films 13, are thermoplastic synthetic fiber yarns of transparent monofilament or multifilament yarns. As a result, the continuous reflecting portion 4 is formed in the web portion 3 contiguous to and along one of the element-attaching marginal portions 2. Alternatively, the reflective member 12 may be in the form of a core cord or yarn with a retroreflective film 13 wound around it. As another alternative reflective member 12, a thermoplastic synthetic fiber yarn may be dyed as with a fluorescent dye.

Figure 15:
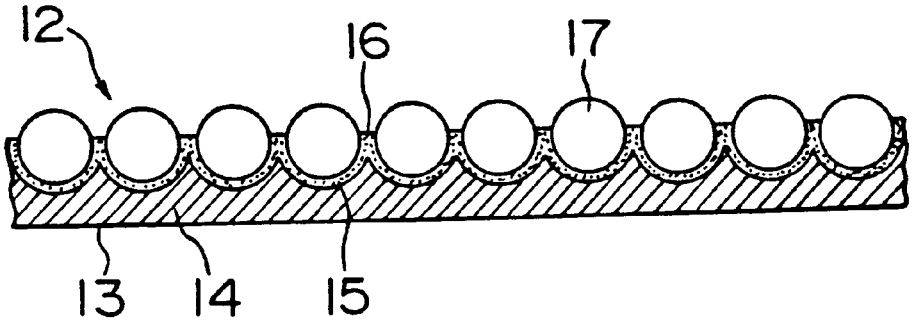
FIG. 15 is a cross-sectional view of a strip of retroreflective film.

For a narrow strip of retroreflective film 13 as the reflective member 12, as shown in FIG. 15, firstly a polyester resin substrate 14 is coated with metal such as aluminum, silver or copper by vapor deposition, plating or painting to form a reflecting coating 15, and the reflecting coating 15 is then covered with a polyvinylbutyral resin adhesive layer 16, whereupon an uncountable number of glass beads 17 are adhered to the adhesive layer 16. Finally the resulting reflecting film sheet is cut into narrow strips. A transparent covering layer may be formed over the entire glass-bead-adhered-side surface of this recurrent reflective film 13.

Figure 16:
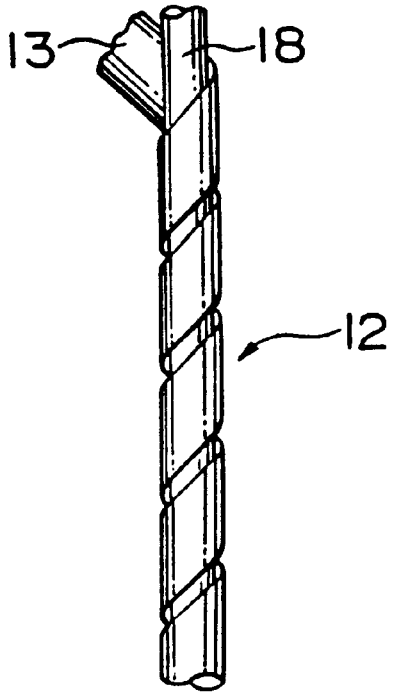
FIG. 16 is an enlarged, fragmentary front view of a reflective member wound with the retroreflective film strip.

As still another alternative retroreflective film 13, as shown in FIG. 16, a narrow strip of retroreflective film 13 is wound around the circumferential surface of a core cord 18 in the form of a monofilament or multifilament synthetic fiber yarn as of polyamide or polyester.

As a further alternative reflective member 12, a monofilament or multifilament synthetic fiber yarn as of polyamide or polyester is dyed with a fluorescent dye or fluorescent white dye or bleached with a fluorescent bleach to be used in the warp-knit tape 1.

Figure 17:
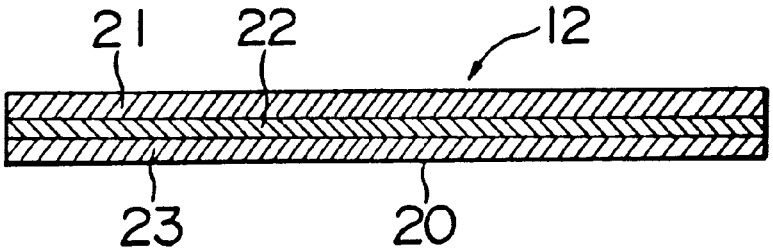
FIG. 17 is an enlarged transverse cross-sectional view of a strip of light-reserve reflective film.

Yet alternatively, the reflective member 12 may be a narrow strip of light-reserve reflective film 20 as shown in FIG. 17. In production, firstly a light-reserve pigment as of $SrAl_2O_4$ is painted over a transparent polycarbonate resin substrate 21 to form a light-reserve layer 22, and then a particular kind of ink, which is obtained by kneading titanium oxide in vanish as of acrylic resin, is painted over a front surface of the light-reserve layer 22 to obtain a reflecting layer 23, whereupon the resulting light-reserve reflective film 20 is cut into narrow strips. As an additional alternative form, the narrow strip of light-reserve reflective film 20, like the retroreflective film 13, may be wound around a core cord as of a synthetic fiber yarn.

As a still further alternative reflecting member 12, a foil spread of silver or gold is stuck to a sheet of high-quality Japanese paper and then the resulting silver- or gold-coated Japanese paper sheet is cut into narrow strips. Yet this narrow strip of silver- or gold-backed Japanese paper may be spun with one of various kinds of strings or filaments to form a silver or gold thread.

Figure 3:
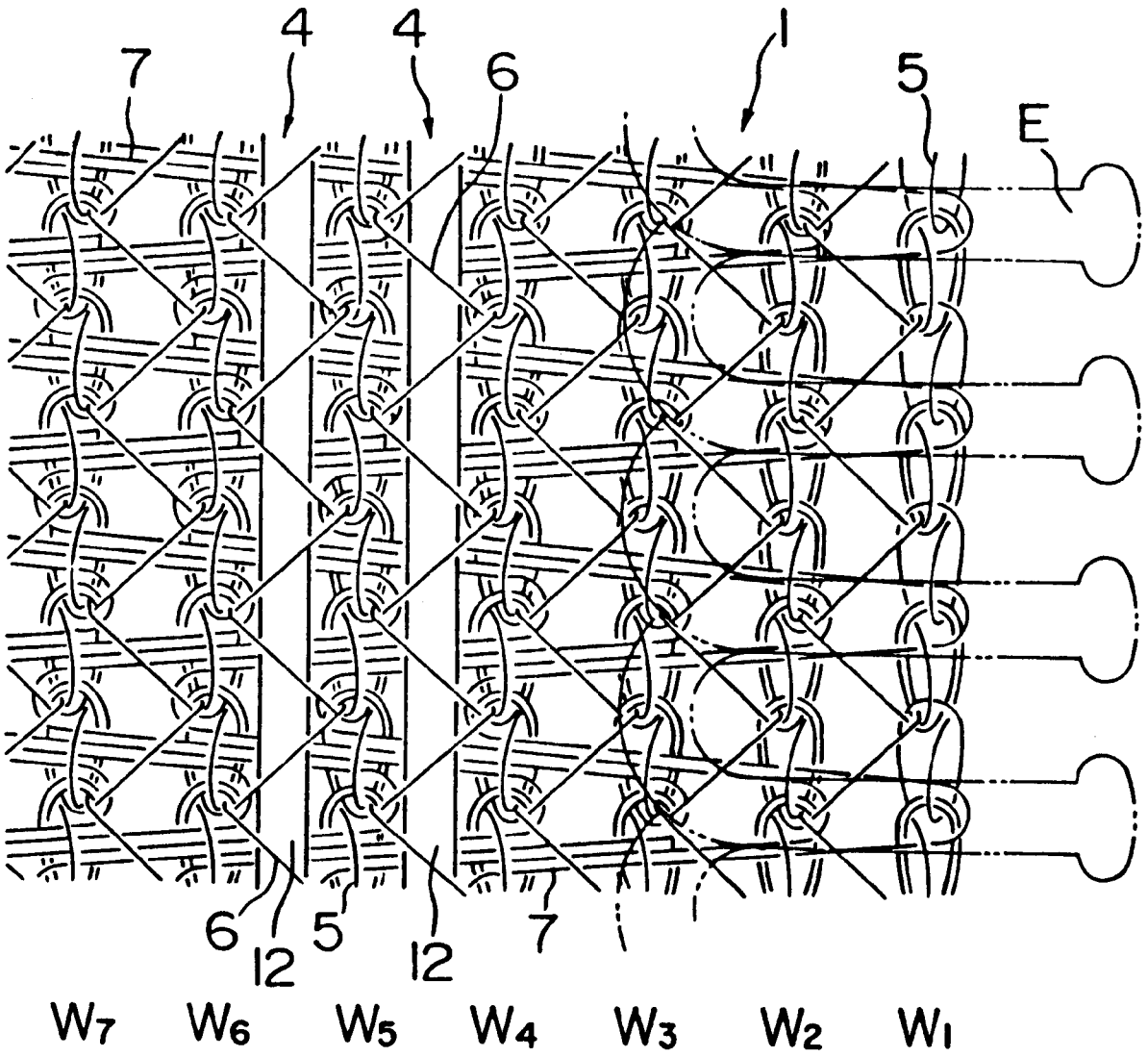
FIG. 3 is an enlarged, fragmentary diagram of a reflecting warp-knit tape according to a second embodiment.

FIG. 3 shows a warp-knit tape 1 according to a second embodiment. In each of all wales $W_1$–$W_{18}$ of this warp-knit tape 1, a chain-stitch yarn 5 of 1-0/0-1, a plurality of tricot-stitch yarns 6 of 1-2/1-0 and a plurality of weft-inlaid yarns 7 of 0-0/4-4 are interlooped and/or interlaced, thus restricting the entire warp-knit tape 1 in longitudinal stretchability. And each of between the fourth and fifth adjacent wales $W_4$, $W_5$ and between the fifth and sixth adjacent wales $W_5$, $W_6$, a narrow strip of retroreflective film 13 or any other reflective member 12 is located and is held by the tricot-stitch yarn 6 and a plurality of weft-inlaid yarns 7 on its front and rear sides, respectively. The tricot-stitch yarns 6 exposed over the front surfaces of the reflecting members 12 such as the retroreflective films 13 are each a transparent thermoplastic synthetic fiber yarn. Thus the individual reflecting portion 4 is exposed to the front surface of the warp-knit tape 1 continuously along its entire length.

Figure 4:
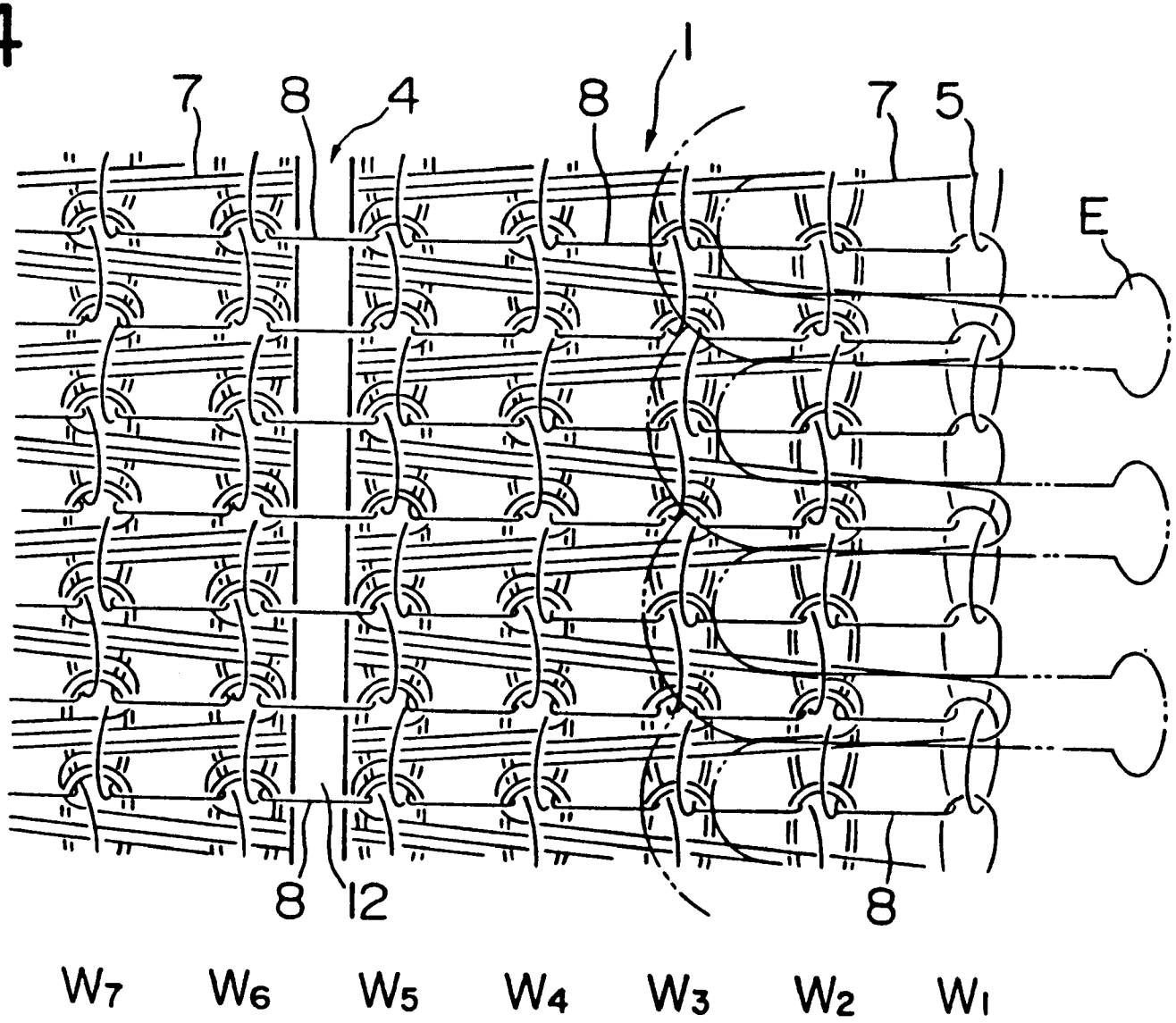
FIG. 4 is an enlarged, fragmentary diagram of a reflecting warp-knit tape according to a third embodiment.

FIG. 4 shows a warp-knit tape 1 according to a third embodiment. In each of all wales $W_1$–$W_{18}$ of this warp-knit tape 1, a plurality of two-needle-stitch yarns 8 of 0-2/2-0 and a plurality of weft-inlaid yarns 7 of 0-0/4-4 are interlooped and interlaced, respectively, thus restricting the entire warp-knit tape 1 in longitudinal stretchability of the warp-knit foundation. And between the fifth and sixth adjacent wales $W_5$, $W_6$, a narrow strip of retroreflective film 13 or any other reflective member 12 is located and is held by the two-needle-stitch yarn 8 and the plurality of weft-inlaid yarns 7 on its front and rear sides, respectively. The two-needle-stitch yarn 8 exposed over the front surface of the reflecting member 12 such as the retroreflective film 13 is a transparent thermoplastic synthetic fiber yarn. Thus the reflecting portion 4 is exposed to the front surface of the warp-knit tape 1 continuously along its entire length. Having this two-needle-stitch yarn 8, the reflective member 12 such as the retroreflective film 13 can be held uniformly along its entire length.

Figure 5:
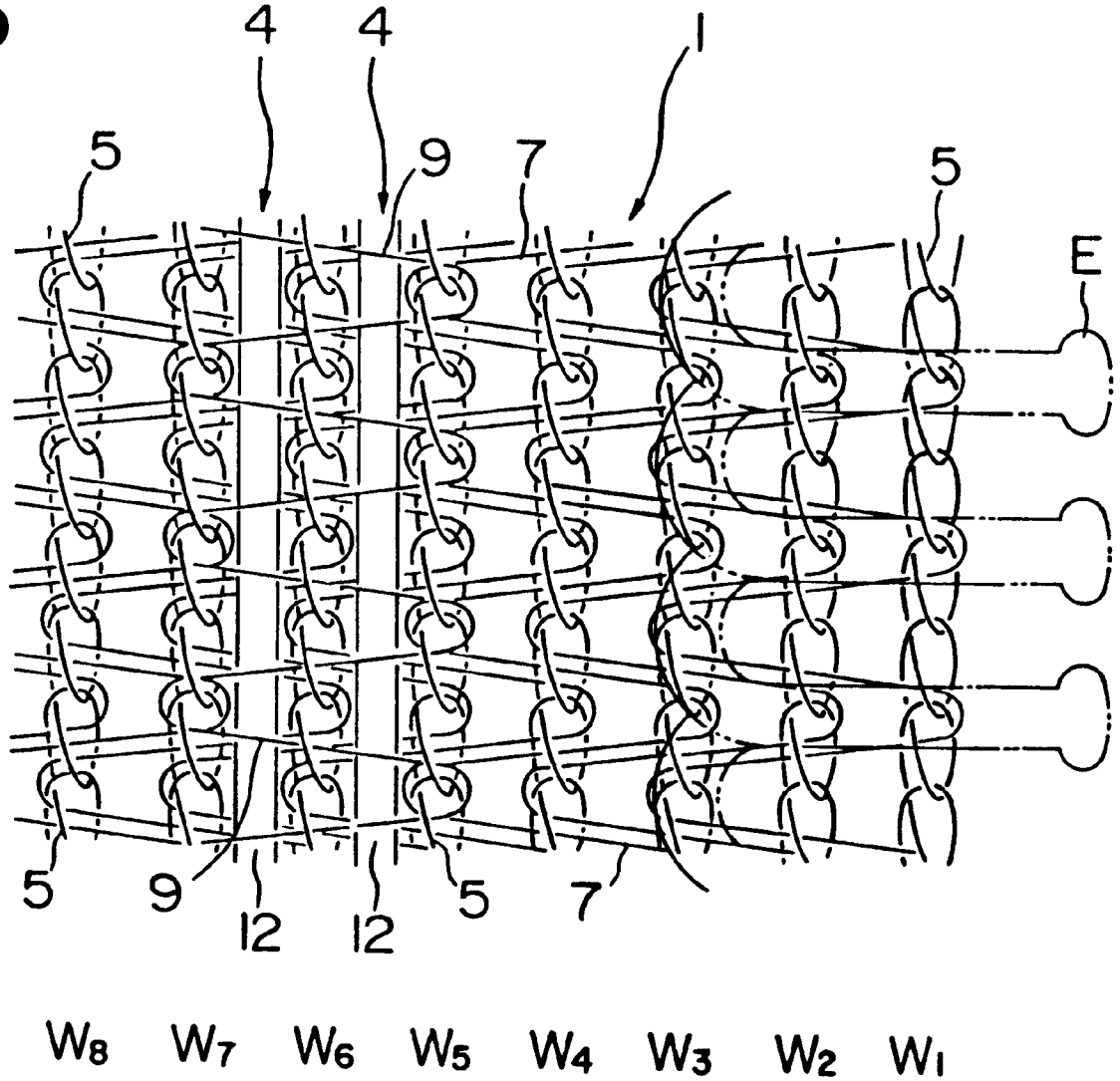
FIG. 5 is an enlarged, fragmentary diagram of a reflecting warp-knit tape according to a fourth embodiment.

FIG. 5 shows a warp-knit tape 1 according to a fourth embodiment. In each of all wales $W_1$–$W_{18}$ of this warp-knit tape 1, a plurality of weft-inlaid yarns 9 of 3-3/0-0 are interlaced with a chain-stitch yarn 5 of 1-0/0-1, thus restricting the entire warp-knit tape 1 in longitudinal stretchability of the warp-knit foundation. And each of between the fifth and sixth adjacent wales $W_5$, $W_6$ and between the sixth and seventh adjacent wales $W_6$, $W_7$, a narrow strip of retroreflective film 13 or any other reflective member 12 is located. Such two reflective members 12 are held by a weft-inlaid yarn 9 of 3-3/0-0 and the plurality of weft-inlaid yarns 7 on their front and rear sides, respectively. And the fastener elements E are sewn onto one longitudinal edge of the tape 1. The weft-inlaid yarn 9 holding the front surface of the reflecting member 12 such as the retroreflective film 13 are each a transparent thermoplastic synthetic fiber yarn. Thus the individual reflecting portion 4 is exposed to the front surface of the warp-knit tape 1 continuously along its entire length.

Figure 6:
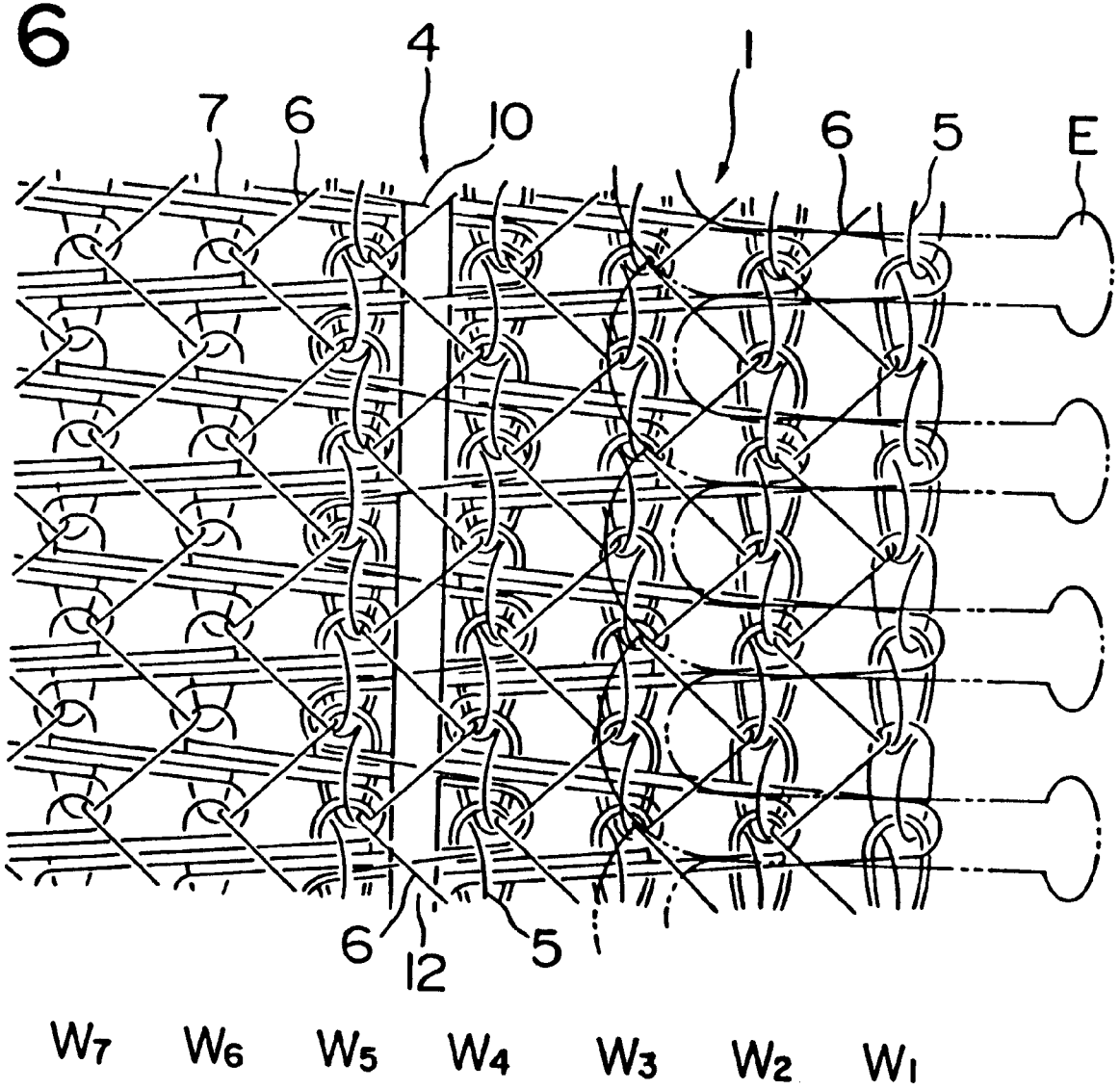
FIG. 6 is an enlarged, fragmentary diagram of a reflecting warp-knit tape according to a fifth embodiment.

FIG. 6 shows a warp-knit tape 1 according to a fifth embodiment. In each of at least from the first to seventh wales $W_1$–$W_7$ of this warp-knit tape 1, a plurality of tricot-stitch yarns 6 of 1-2/1-0 and a plurality of weft-inlaid yarns 7 of 0-0/4-4 are interlooped and interlaced, respectively, and in each of the first to fifth wales $W_1$–$W_5$, a chain-stitch yarn 5 is interlooped and interlaced with the tricot-stitch yarns 6 and the weft-inlaid yarns 7, respectively, thus restricting the warp-knit tape 1 in longitudinal stretchability of the warp-knit foundation. And between the fourth and fifth adjacent wales $W_4$, $W_5$, a narrow strip of retroreflective film 13 or any other reflective member 12 is located and the retroreflective film 13 is held by the tricot-stitch yarn 6 and the plurality of weft-inlaid yarns 7 on its front and rear sides, respectively. Also between the fourth and fifth adjacent wales $W_4$, $W_5$, an additional weft-inlaid yarn 10 of 0-0/2-2 is located over the retroreflective film 13 so as to cross the tricot-stitch yarn 6. Both these tricot-stitch and weft-inlaid yarns 6, 10 exposed on the front surface of the reflecting member 12 such as the retroreflective film 13 are each a transparent thermoplastic synthetic fiber yarn. Thus the reflecting portion 4 is exposed to the front surface of the warp-knit tape 1 continuously along its entire length. The chain-stitch yarns 5 of the first wale $W_1$ and the fourth and fifth adjacent wales $W_4$, $W_5$, which are located on opposite sides of the reflective member 12, may be each a large-size knitting yarn to increase especially the fourth and fifth wales $W_4$, $W_5$ in volume than the remaining wales, thereby realizing protection of the reflective member 12.

Figure 7:
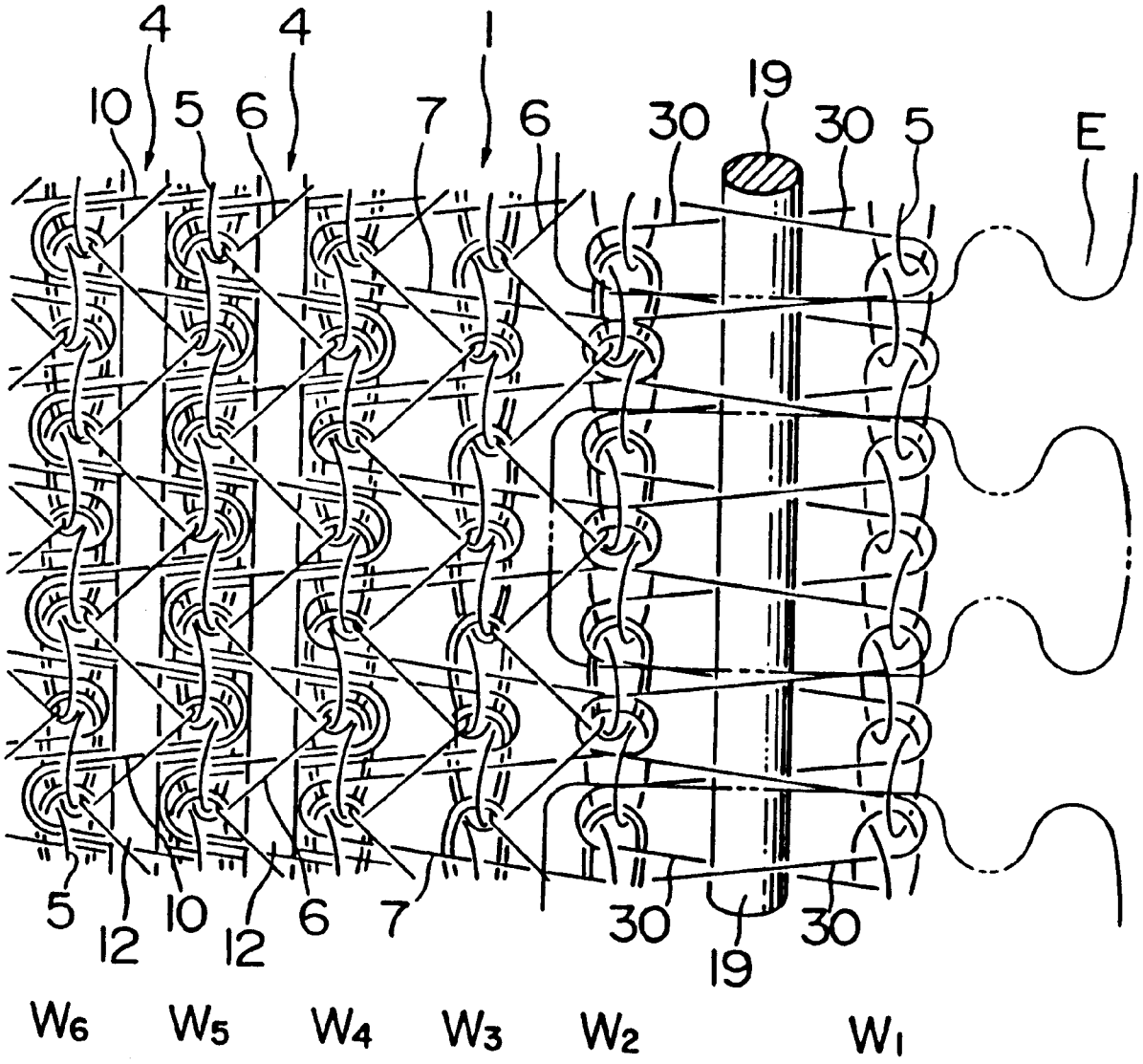
FIG. 7 is an enlarged, fragmentary diagram of a reflecting warp-knit tape according to a sixth embodiment.

FIG. 7 shows a warp-knit tape 1 according to a sixth embodiment. In at least the first to sixth wales $W_1$–$W_6$ of this warp-knit tape 1, a chain-stitch yarn 5 of 1-0/0-1 is knitted, and in each of the second to sixth wales $W_2$–$W_6$, a plurality of tricot-stitch yarns 6 of 1-2/1-0 and a plurality of weft-inlaid yarns 7 of 0-0/3-3 are interlooped and interlaced, respectively, with the chain-stitch yarn 5. The chain-stitch yarn 5 of the first wale $W_1$ is larger in size than the remaining chain-stitch yarns 5. And between the first and second adjacent wales $W_1$, $W_2$ whose interwale space is expanded, one of various kinds of thick core cord 19, which is composed of a plurality of synthetic fiber threads or filaments, is located and is held by a pair of symmetrically arranged weft-inlaid yarns 30 of 0-0/1-1 on its front and rear sides. Further, each of between the fourth and fifth adjacent wales $W_4$, $W_5$ and the fifth and sixth adjacent wales $W_5$, $W_6$, a narrow strip of retroreflective film 13 or any other reflective member 12 is located and is held as being sandwiched by the tricot-stitch yarn 6 and the weft-inlaid yarns 7, respectively. In addition to the tricot-stitch yarns 6, additional weft-inlaid yarns 10 of 0-0/1-1 are located over the reflective members 12 as retroreflective film 13 so as to cross the tricot-stitch yarns 6. Both these tricot-stitch and weft-inlaid yarns 6, 10 exposed on the front surface of the reflecting member 12 such as the retroreflective film 13 are each a transparent thermoplastic synthetic fiber yarn. Thus the reflecting portion 4 is exposed to the front surface of the warp-knit tape 1 continuously along its entire length.

On and along the thick core cord 19 laid in the one longitudinal edge of the warp-knit tape 1, a row of fastener elements E may be molded of thermoplastic resin, such as polyamide, polypropylene or polybutyleneterephthalate, by injection molding means, or a row of metal fastener elements E may be mounted by pressing.

Figure 8:
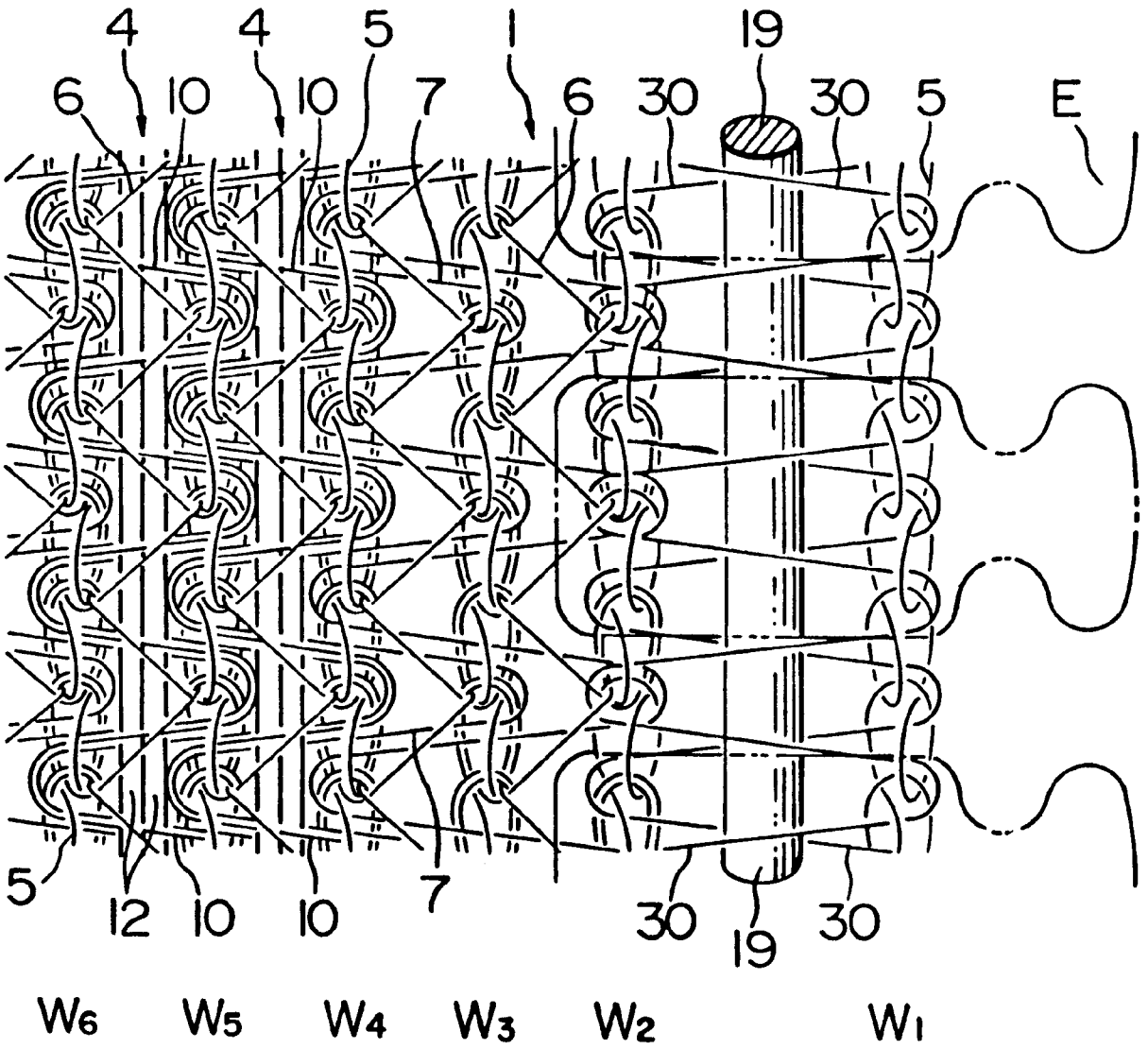
FIG. 8 is an enlarged, fragmentary diagram showing a modified reflecting warp-knit tape of FIG. 7.

FIG. 8 shows a modified warp-knit tape 1 of FIG. 7. This warp-knit tape 1 is identical in knit structure with that of the embodiment of FIG. 7. In at least the first to sixth wales $W_1$–$W_6$ of this warp-knit tape 1, a chain-stitch yarn 5 of 1-0/0-1 is knitted, and in each of the second to sixth wales $W_2$–$W_6$, a plurality of tricot-stitch yarns 6 of 1-2/1-0 and a plurality of weft-inlaid yarns 7 of 0-0/3-3 are interlooped and interlaced, respectively, with the chain-stitch yarn 5. The chain-stitch yarn 5 of the first wale $W_1$ is larger in size than the remaining chain-stitch yarns 5. And between the first and second adjacent wales $W_1$, $W_2$ whose interwale space is expanded, one of various kinds of thick core cord 19, which is composed of a plurality of synthetic fiber threads or filaments, is located and is held by a pair of symmetrically arranged weft-inlaid yarns 30 of 0-0/1-1 on its front and rear sides. Further, each of between the fourth and fifth adjacent wales $W_4$, $W_5$ and the fifth and sixth adjacent wales $W_5$, $W_6$, a pair of narrow strips of retroreflective film 13 or a pair of any other reflective members 12 are located and are held as being sandwiched by the tricot-stitch yarn 6 and the weft-inlaid yarns 7, respectively. In addition to the tricot-stitch yarns 6, additional weft-inlaid yarns 10 of 0-0/1-1 are located over the pair of reflective members 12 such as the pair of narrow strips of retroreflective film 13 so as to cross the tricot-stitch yarns 6. Thus a pair of parallel double-reflective-cord reflecting portions 4 are obtained, extending longitudinally along the entire length of the warp-knit foundation of the warp-knit tape 1.

The number of reflective members 12 to be knitted in the warp-knit tape 1 as a single reflecting portion 4 should by no means be limited to two and may be more than two and less than many. As an alternative reflective member 12, as shown in FIG. 16, a narrow strip of recurrent reflecting film 13 is wound around the circumferential surface of a core cord 18 of a thermoplastic synthetic fiber yarn and such wound core cords or strings, or silver or gold threads may be disposed in parallel. Each reflective member 12 may be composed of a cord formed by knitting or by braiding the wound core cord or string, or silver or gold threads.

Figure 9:
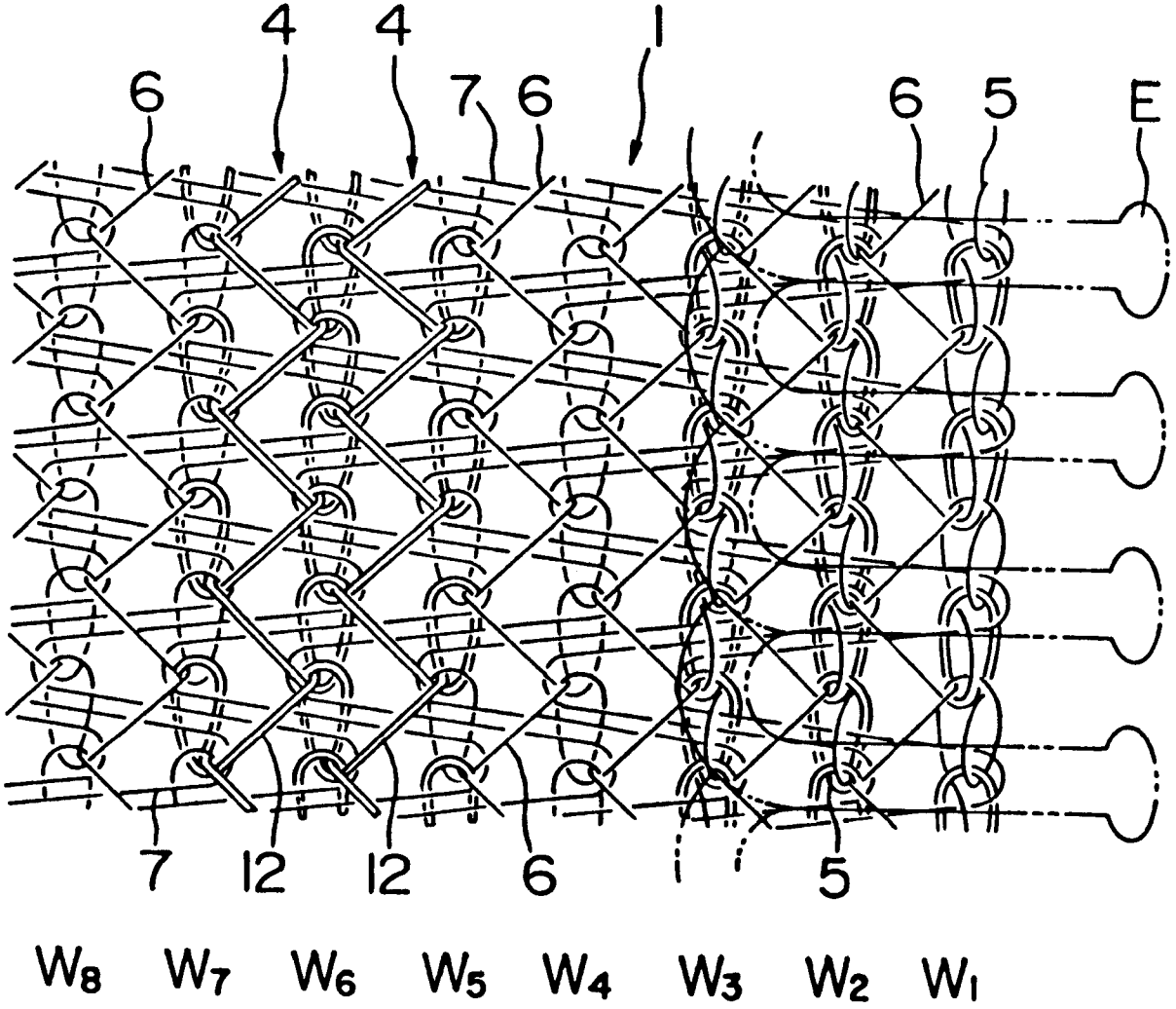
FIG. 9 is an enlarged, fragmentary diagram of a reflecting warp-knit tape according to a seventh embodiment.

FIG. 9 shows a warp-knit tape 1 according to a seventh embodiment. In each of the first to third wales $W_1$–$W_3$ of this warp-knit tape 1, a chain-stitch yarn 5 of 1-0/0-1 is knitted, and only the chain-stitch yarn 5 of the first wale $W_1$ is larger in size than the remaining chain-stitch yarns 5. And in each of at least the first to eighth wales $W_1$–$W_8$, a plurality of tricot-stitch yarns 6 of 1-2/1-0 and a plurality of weft-inlaid yarns 7 of 0-0/3-3 are interlooped and interlaced, respectively, with the chain-stitch yarn 5. The tricot-stitch yarns 6 extending between the fifth and sixth adjacent wales $W_5$, $W_6$ and between the sixth and seventh adjacent wales $W_6$, $W_7$ are each composed of a reflective member 12 in the form of a knitting yarn in which a core cord 18 is in the form of a thermoplastic synthetic fiber yarn, and a narrow strip of retroreflecting film 13 is wound around the circumferential surface of the core cord 18, as shown in FIG. 16, or a knitting yarn around which a narrow strip of light-reserve reflective film 20 is wound, as shown in FIG. 17, or each in the form of a thermoplastic synthetic fiber yarn dyed with a fluorescent dye or fluorescent white dye or bleached with a fluorescent bleach, or each in the form of a silver or gold thread.

The kind of the knitting yarns to be used as the reflective members 12 each constituting a reflecting portion 4 should by no means be limited to tricot-stitch yarns and may be chain-stitch yarns, two-needle-stitch yarns, single-cord-stitch yarns or even mere weft-inlaid yarns, as long as they are located and knitted in and between a necessary number of wales. After all, the resulting reflecting portion 4 serves to produce a continuous reflecting feature along the entire length of the warp-knit tape 1.

Figure 10:
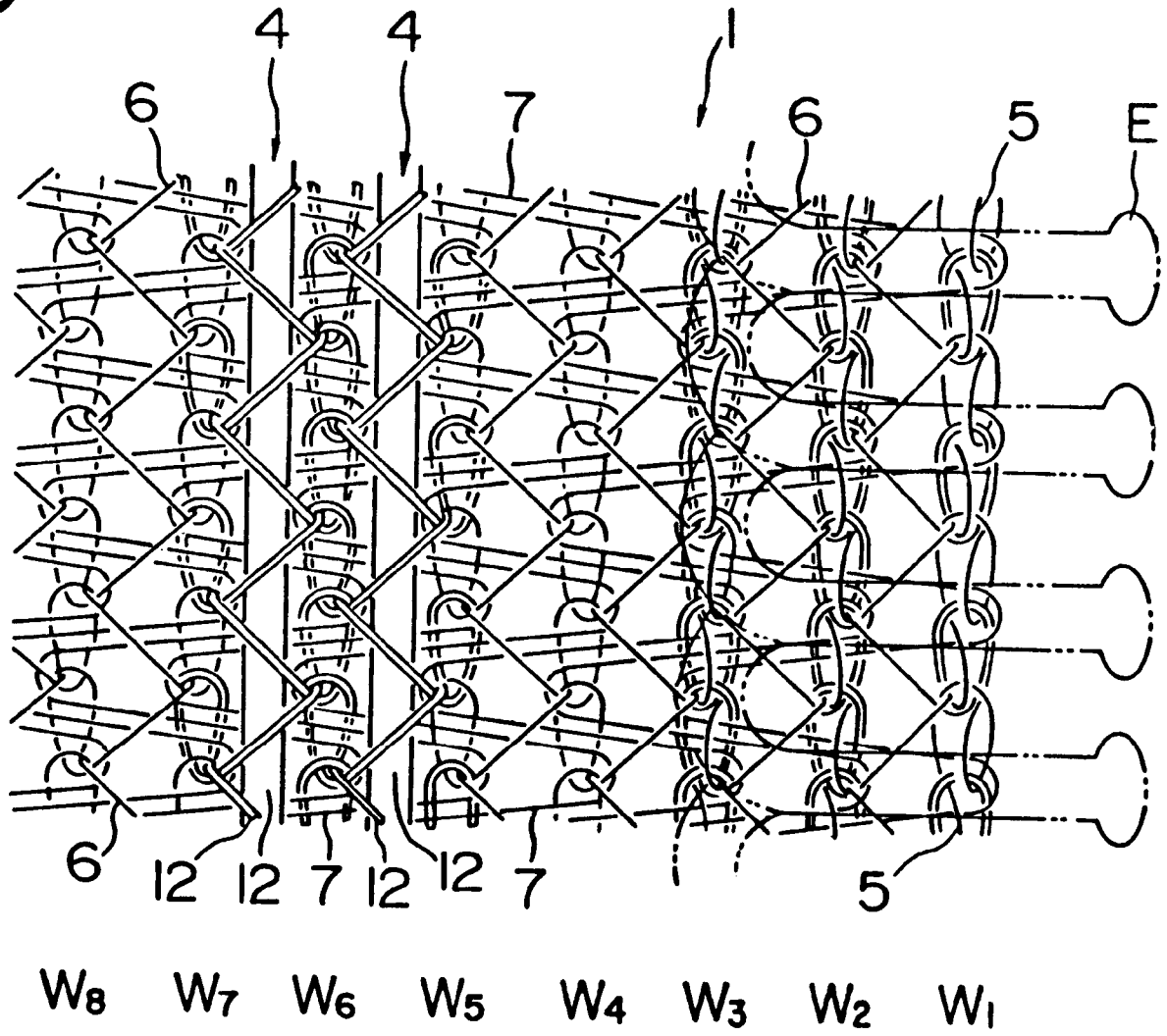
FIG. 10 is an enlarged, fragmentary diagram of a reflecting warp-knit tape according to an eighth embodiment.

FIG. 10 shows a warp-knit tape 1 according to an eighth embodiment. In each of the first to third wales $W_1$–$W_3$ of this warp-knit tape 1, like the seventh embodiment of FIG. 9, a chain-stitch yarn 5 of 1-0/0-1 is knitted, and only the chain-stitch yarn 5 of the first wale $W_1$ is larger in size than the remaining chain-stitch yarns 5. And in each of at least the first to eighth wales $W_1$–$W_8$, a plurality of tricot-stitch yarns 6 of 1-2/1-0 and a plurality of weft-inlaid yarns 7 of 0-0/3-3 are interlooped and interlaced, respectively, of the chain-stitch yarn 5. Further, each of between the fifth and sixth adjacent wales $W_5$, $W_6$ and between the sixth and seventh adjacent wales $W_6$, $W_7$, a reflective member 12 composed of a narrow strip of retroreflective film 13 or any other reflective member 12 is located and is held by a tricot-stitch yarn 6 and a plurality of weft-inlaid yarns 7, respectively on its front and rear sides. In addition, the tricot-stitch yarns 6 of 1-2/1-0 extending between the fifth and sixth adjacent wales $W_5$, $W_6$ and between the sixth and seventh adjacent wales $W_6$, $W_7$ are each composed of the reflective member 12 in the form of a knitting yarn in which a core cord 18 is in the form of a thermoplastic synthetic fiber yarn, and a narrow strip of retroreflective film 13 is wound around the core cord 18, or a knitting yarn around which a narrow strip of light-reserve reflective film 20 is wound, or each in the form of a thermoplastic synthetic fiber yarn dyed with a fluorescent dye or fluorescent white dye or bleached with a fluorescent bleach, or each in the form of a silver or gold thread so that the continuous reflecting portions 4 can be formed. In the warp-knit tape 1 of this embodiment, since each reflecting portion 4 is constituted by combining the two different kinds of reflective members 12 in an overlapping relationship, it can produce a reflecting feature with maximum definition.

Figure 11:
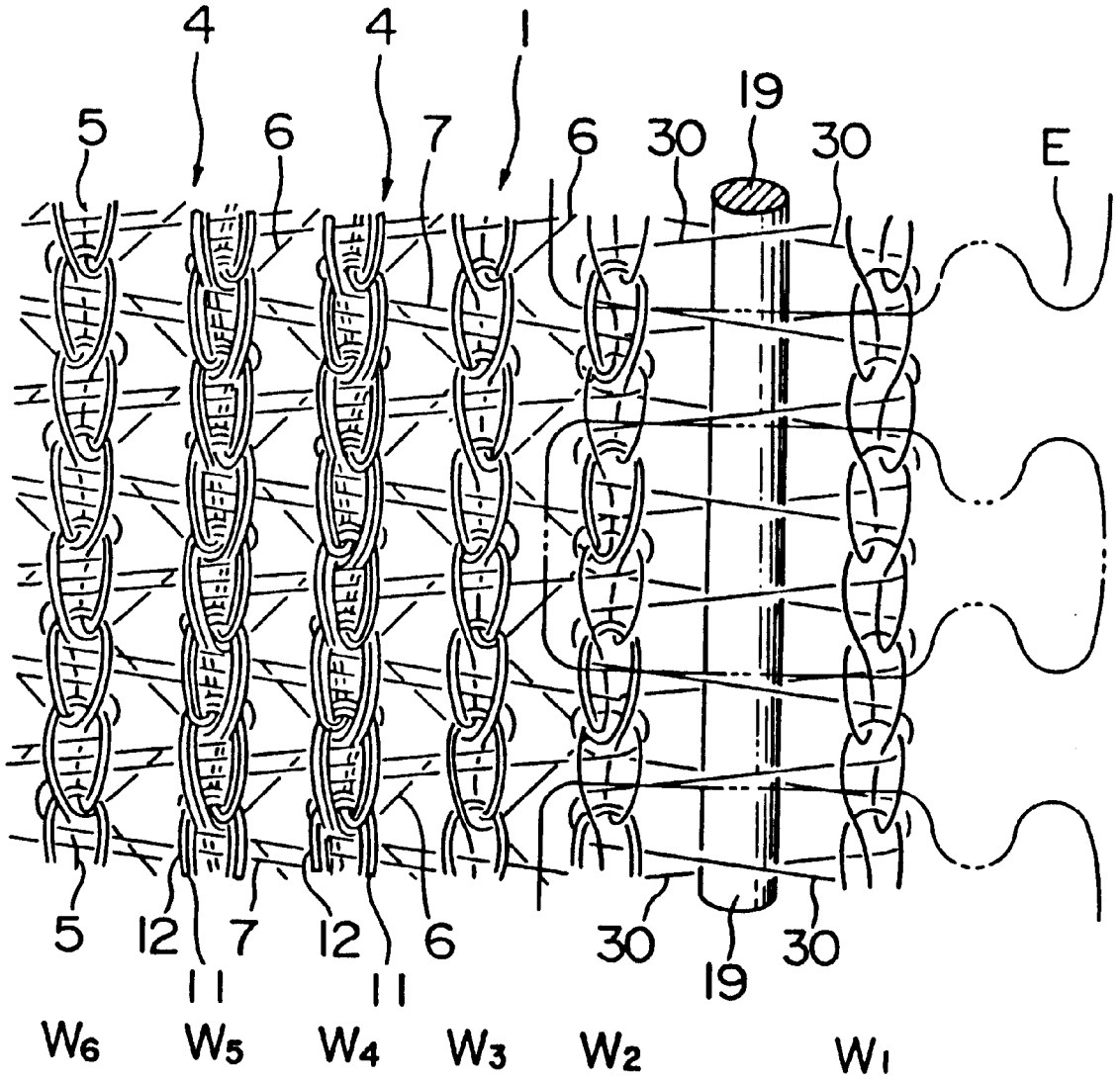
FIG. 11 is an enlarged, fragmentary diagram of a reflecting warp-knit tape according to a ninth embodiment.

FIG. 11 shows a warp-knit tape 1 according to a ninth embodiment. In each of at least the first to sixth wales $W_1$–$W_6$ of this warp-knit tape 1, a chain-stitch yarn 5 of 1-0/0-1 is knitted, and only the chain-stitch yarn 5 of the first wale $W_1$ is larger in size than the remaining chain-stitch yarns 5. Yet in each of the second to sixth wales $W_2$–$W_6$, a plurality of tricot-stitch yarns 6 of 1-2/1-0 and a plurality of weft-inlaid yarns 7 of 0-0/3-3 are interlooped and interlaced, respectively, with the chain-stitch yarn 5 of 1-0/0-1. Between the first and second adjacent wales $W_1$, $W_2$ whose interwale space is expanded, a selected one of various kinds of thick core cord 19, which is composed of a plurality of synthetic fiber threads or filaments, is located and is held by a pair of symmetrically arranged weft-inlaid yarns 30 of 0-0/1-1 on its front and rear sides. For each of the chain-stitch yarns 5 extending in and along the fourth and fifth wales $W_4$, $W_5$, a reflective member 12 which is composed of a core cord 18 of a thermoplastic synthetic fiber yarn and a narrow strip of retroreflective film 13 wound around the core cord 18, or composed of a knitting yarn and a narrow strip of light-reserve reflective film 20 wound around the knitting yarn, or a knitting yarn of a thermoplastic synthetic fiber yarn dyed with a fluorescent dye or fluorescent white dye or bleached with a fluorescent bleach, or a silver or gold yarn is used so that a continuous reflecting portion 4 is formed. On and along the thick core cord 19 laid in the marginal portion of the warp-knit tape 1, a row of fastener elements E may be molded of thermoplastic resin or a row of metal fastener elements E may be mounted, thus completing a continuous length of slide fastener stringer.

Figure 12:
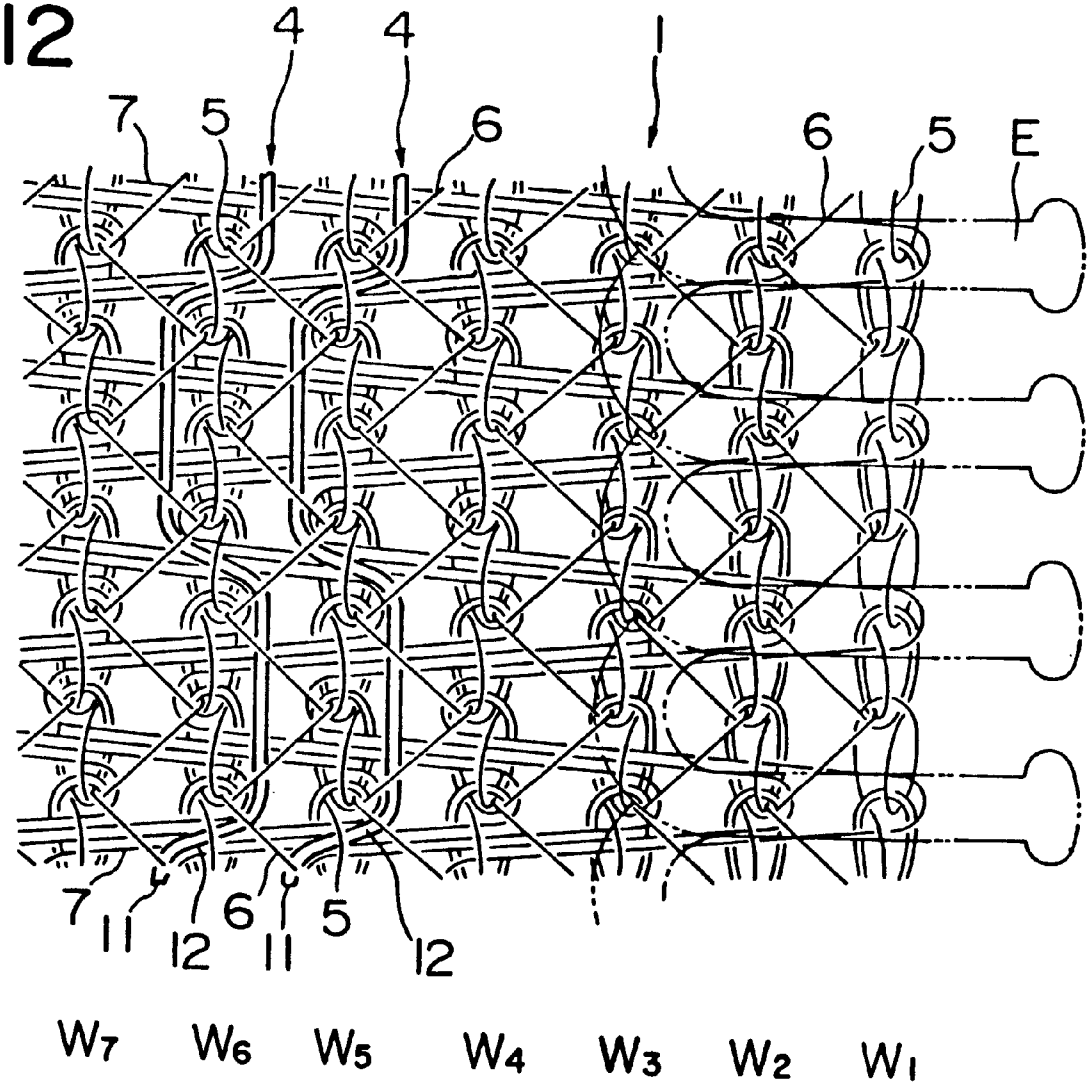
FIG. 12 is an enlarged, fragmentary diagram of a reflecting warp-knit tape according to a tenth embodiment.

FIG. 12 shows a warp-knit tape 1 according to a tenth embodiment. In each of at least the first to seventh wales $W_1$ $W_7$ of this warp-knit tape 1, a chain-stitch yarn 5 of 1-0/0-1, a plurality of tricot-stitch yarns 6 of 1-2/1-0 and a plurality of weft-inlaid yarns 7 of 0-0/4-4 are interlooped and/or interlaced to form the warp-knit foundation. In addition, a pair of analogous warp-inlaid yarns 11 of 0-0/0-0/0-0/1-1/1-1/1-1/1-1 are laid in and along the fifth and sixth adjacent wales $W_5$, $W_6$, respectively, using reflective members 12 each composed of a core cord 18, which is in the form of a thermoplastic synthetic fiber yarn, and a narrow strip of retroreflective film 13 or a narrow strip of light-reserve reflective film 20 wound around the core cord 18, as shown in FIG. 16, or each being a thermoplastic synthetic fiber yarn dyed with a fluorescent dye or fluorescent white dye or bleached with a fluorescent bleach, or a silver or gold thread. Thus each warp-inlaid yarn 11 is interlaced with the chain-stitch yarn 5 of a respective one of the fifth and sixth wales $W_5$, $W_6$ at every three courses. The chain-stitch yarns 5 and the tricot-stitch yarns 6 in the fifth and sixth adjacent wales $W_5$, $W_6$ are transparent thermoplastic synthetic resin fiber yarns and, as a result, a pair of parallel continuous reflecting portions 4 are formed in the web portion 3 along the entire length of the warp-knit tape 1.

Figure 13:
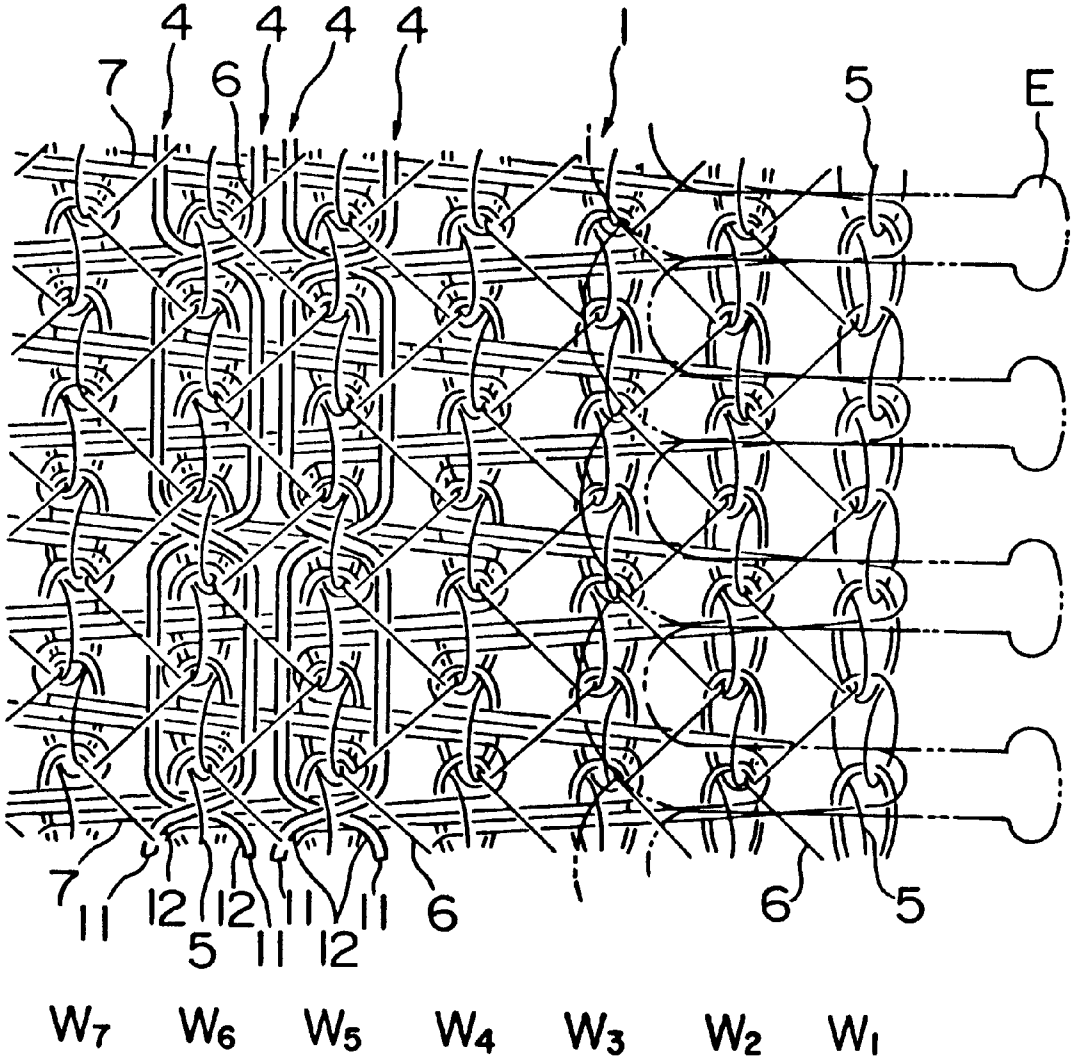
FIG. 13 is an enlarged, fragmentary diagram of a reflecting warp-knit tape according to an eleventh embodiment.

FIG. 13 shows a warp-knit tape 1 according to an eleventh embodiment. In each of at least the first to seventh wales $W_1$ $W_7$ of this warp-knit tape 1, like the tenth embodiment of FIG. 12, a chain-stitch yarn 5 of 1-0/0-1, a plurality of tricot-stitch yarns 6 of 1-2/1-0 and a plurality of weft-inlaid yarns 7 of 0-0/4-4 are interlooped and/or interlaced to form the warp-knit foundation. In addition, a pair of analogous warp-inlaid yarns 11 of 00/0-0/0-0/1-1/1-1/1-1 and 1-1/1-1/1-1/0-0/0-0/0-0, respectively, are laid in and along the fifth and sixth adjacent wales $W_5$, $W_6$, using reflective members 12 each composed of a core cord 18 of a thermoplastic synthetic fiber yarn and a narrow strip of retroreflective film 13 or a narrow strip of light-reserve reflective film 20 wound around the core cord 18, or each being a thermoplastic synthetic fiber yarn dyed with a fluorescent dye or fluorescent white dye or bleached with a fluorescent bleach, or a silver or gold thread. Thus each of the fifth and sixth wales $W_5$, $W_6$ Of the pair of warp-inlaid yarns 11 are knitted symmetrically in a pattern of 0-0/0-0/0-0/1-1/1-1/1-1 and a pattern of 11/1-1/1-1/0-0/0-0/0-0 with the chain-stitch yarns 5 of 1-2/1-0, crossing each other at every three courses. The chain-stitch yarns 5 and the tricot-stitch yarns 6 in the fifth and sixth adjacent wales $W_5$, $W_6$ are transparent thermoplastic synthetic resin fiber yarns. As a result, a pair of continuous uniform rather wide reflecting portions 4 are formed in the web portion 3 along the entire length of the warp-knit tape 1.

Figure 14:
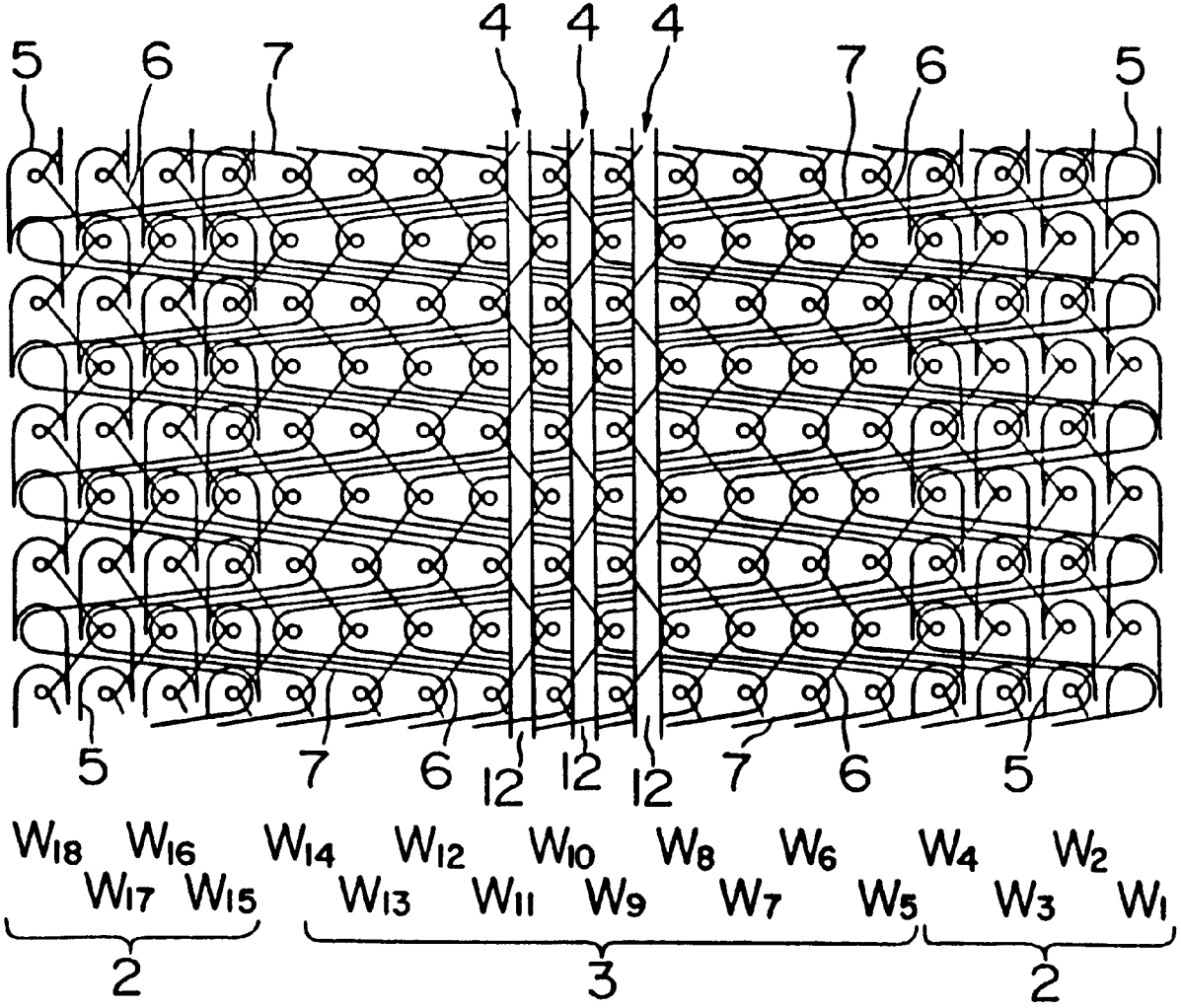
FIG. 14 is an enlarged, fragmentary diagram of a reflecting warp-knit tape according to a twelfth embodiment.

FIG. 14 shows a warp-knit tape 1 according to a twelfth embodiment. In each of all wales $W_1$–$W_{18}$ of this warp-knit tape 1, a plurality of tricot-stitch yarns 6 of 1-2/1-0 and a plurality of weft-inlaid yarns 7 of 0-0/4-4 are interlooped and interlaced, respectively, and in each of the first to fourth wales $W_1$–$W_4$ (right marginal portion 2) and fifteenth to eighteenth wales $W_{15}$–$W_{18}$ (left marginal portion 2), a chain-stitch yarn 5 of 1-0/0-1 is interlooped and interlaced with the tricot-stitch yarn 6 and the weft-inlaid yarn 7, respectively to form a warp-knit foundation. And each of between the eighth and ninth adjacent wales $W_8$, $W_9$, between the ninth and tenth adjacent wales $W_9$, $W_{10}$ and between the tenth and eleventh adjacent wales $W_{10}$, $W_{11}$ which are located centrally, a narrow strip of retroreflective film 13 as a reflective member 12 or any other reflective member 12 is located and is knitted to be held as being sandwiched by the tricot-stitch yarn 6 and the weft-inlaid yarn 7 on its front and rear sides, respectively. The tricot-stitch yarns 6 exposed over the front surfaces of the reflective members 12 such as the retroreflective films 13 are each a transparent thermoplastic synthetic fiber yarn. Thus a set of parallel three reflecting portions 4 are exposed to the front surface of the warp-knit tape 1 continuously along its entire length.

In a subsequent manufacturing step of the slide fastener production, a row of fastener elements are attached to one of the two marginal portions 2 such as by sewing; accordingly, either marginal portion 2, i.e., either $W_1$–$W_4$ or $W_{15}$–$W_{18}$ may serve to support the fastener element row and is hence called the element-attaching marginal portion 2. Therefore, the warp-knit tape 1 of the present invention can be used to manufacture either one of two opposite fastener stringers.

The warp-knit tape 1 of this invention should by no means be limited to the illustrated examples and its warp-knit structure may be composed of various knitting yarns in any optional combination; stitches of the individual knitting yarn may be either open stitches or closed stitches. Further, regarding the width of the warp-knit tape 1 and the location of the reflective member 12, various changes or modifications may be made to meet the purpose of use.

Furthermore, the number of the reflective members 12 should by no means be limited to two and may be more than two and less than many. And the reflective members 12 to be knitted may be each composed not only of a core cord 18 of a thermoplastic synthetic fiber yarn and a narrow strip of retroreflective film 13 wound around the circumferential surface of the core cord 18, as shown in FIG. 16, or of a knitting yarn and a narrow strip of light-reserve reflective film 20 wound around the knitting yarn, as shown in FIG. 17, or of a thermoplastic synthetic fiber yarn dyed with a fluorescent dye or fluorescent white dye or bleached with a fluorescent bleach, or of a silver or gold thread, disposed in parallel, but also of a cord formed by knitting or by braiding such wound cord, or silver or gold thread.

It is thus apparent that the present invention is not limited to the above embodiments but various other modifications or changes may be made without departing from the scope and spirit of the invention.

What is claimed is:

1. A reflecting warp-knit tape for a slide fastener having a plurality of kinds of warp-knit structure, comprising:

(a) a longitudinal web portion; and (b) an element-attaching marginal portion extending contiguous to and along a longitudinal edge of said web portion, said element-attaching marginal portion having a knit structure which is longitudinally non-stretchable;

(c) said web portion having a reflecting portion composed of at least a reflective member made of reflective material: and (d) said reflective member is knitted in to be located between adjacent wales and to be held by and sandwiched between other knitting yarns and that said knitting yarns have different knitting patterns, thereby holding and sandwiching said reflective member by a plurality of said knitting yarns.

2. A reflecting warp-knit tape according to claim 1, wherein said reflecting portion is formed by knitting said reflective member adjacent to an inner side of said longitudinal edge of said marginal portion of said web portion to extend substantially parallel to said element-attaching marginal portion.

3. A reflecting warp-knit tape according to claim 1, wherein said reflecting portion is formed by knitting said reflective member weftwise centrally in said web portion to extend longitudinally thereof.

4. A reflecting warp-knit tape according to claim 1, wherein wales of said web portion, which are located at opposite sides of said reflecting portion, are bulkier than the remaining wales.

5. A reflecting warp-knit tape according to claim 1, wherein those of said knitting yarns exposed over a front surface of said reflective member are transparent thermoplastic synthetic fiber yarns.

6. A reflecting warp-knit tape according to claim 1, wherein said knitting yarns have a knitting pattern to extend parallel to courses of said web portion so that a front surface of said reflective member is held by said knitting yarns extending parallel to said courses.

7. A reflecting warp-knit tape according to claim 1, wherein said reflective member is in the form of a narrow strip of retroreflective film.

8. A reflecting warp-knit tape according to claim 1, wherein said reflective member is composed of a core cord of a thermoplastic synthetic fiber yarn and a narrow strip of retroreflective film wound around said core cord.

9. A reflecting warp-knit tape according to claim 1, wherein said reflective member is in the form of a strip of light-reserve reflective film.

10. A reflecting warp-knit tape according to claim 1, wherein said reflective member is in the form of a narrow strip of foil or a yarn, of silver or gold.

11. A reflecting warp-knit tape according to claim 1, wherein a plurality of said reflective members are each knitted in to be located between adjacent wales and to be held by and sandwiched between other knitting yarns, and that said other knitting yarns are two or more knitting yarns of different kinds.

12. A reflecting warp-knit tape for a slide fastener having a plurality kinds of warp-knit structure, comprising:

(a) a longitudinal web portion; and (b) an element-attaching marginal portion extending contiguous to and along a longitudinal edge of said web portion, said element-attaching marginal portion having a knit structure which is longitudinally non-stretchable;

(c) said web portion having a reflecting portion composed of at least a reflective member made of reflective material; and (d) said reflective member is a knitting yarn forming a wale.

13. A reflecting warp-knit tape according to claim 12, wherein said knitting yarn serving as said reflective member is composed of a core cord of a thermoplastic synthetic fiber yarn and a narrow strip of retroreflective film wound around said core cord.

14. A reflecting warp-knit tape according to claim 12, wherein said knitting yarn serving as said reflective member is a thermoplastic synthetic fiber yarn dyed with fluorescent dye.

15. A reflecting warp-knit tape according to claim 12, wherein said knitting yarn serving as said reflective member is in the form of a silver or gold thread.

16. A reflecting warp-knit tape according to claim 12, wherein said knitting yarn serving as said reflective member is a thermoplastic synthetic fiber yarn, and that said knitting yarns form two or more wales.

17. A reflecting warp-knit tape according to claim 1, wherein said reflective members are a plurality of knitting yarns, each of which is in the form of a thermoplastic synthetic fiber yarn, knitted in as warp-inlaid yarns each interlaced with one kind of said knitting yarns of a wale at every two or more courses, that each said reflective member is located over other knitting yarns between adjacent wales.

18. A reflecting warp-knit tape according to claim 1, wherein said reflective members are two or more knitting yarns, each of which is a thermoplastic synthetic fiber yarn, knitted in as warp-inlaid yarns each interlaced with one kind of said knitting yarns of a wale at every two or more courses, and that such two or more reflective members are uniformly distributed on opposite sides of a wale in parallel to one another.

19. A reflecting warp-knit tape for a slide fastener having a plurality of kinds of warp-knit structure, comprising:

(a) a longitudinal web portion; and (b) an element-attaching marginal portion extending contiguous to and along a longitudinal edge of said web portion, said element-attaching marginal portion having a knit structure which is longitudinally non-stretchable;

(c) said web portion having a reflecting portion composed of at least a reflective member made of reflective material;

(d) said reflective member is knitted in to be located between adjacent wales and to be held by and sandwiched between other knitting yarns above and below said reflective member and that said knitting yarns have different knitting patterns, thereby holding and sandwiching said reflective member by a plurality of said knitting yarns; and (e) said knitting yarn lying above said reflective member comprising between wale loop portions of a tricot-stitch yarn.

20. A reflecting warp-knit tape for a slide fastener having a plurality of kinds of warp-knit structure, comprising:

(a) a longitudinal web portion; and (b) an element-attaching marginal portion extending contiguous to and along a longitudinal edge of said web portion, said element-attaching marginal portion having a knit structure which is longitudinally non-stretchable;

(c) said web portion having a reflecting portion composed of at least a reflective member made of reflective material; and (d) said reflective member is knitted in to be located between adjacent wales and to be held by and sandwiched between other knitting yarns above and below said reflective member and that said knitting yarns have different knitting patterns, thereby holding and sandwiching said reflective member by a plurality of said knitting yarns;

(e) said knitting yarns lying over said reflective member comprising between wale loop portions of two-needle stitch yarns.

* * * * *